US010245639B2

(12) United States Patent
Wusatowska-Sarnek et al.

(10) Patent No.: US 10,245,639 B2
(45) Date of Patent: Apr. 2, 2019

(54) POWDER METALLURGY METHOD FOR MAKING COMPONENTS

(75) Inventors: Agnieszka M. Wusatowska-Sarnek, Mansfield Ctr., CT (US); Ronald S. Mace, Newnan, GA (US); Harpreet Wasan, Columbus, GA (US); Ruston M. Moore, Clinton, NY (US); John M. Wezalis, Ilion, NY (US); Larry G. Housefield, Portland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1984 days.

(21) Appl. No.: 13/563,216

(22) Filed: Jul. 31, 2012

(65) Prior Publication Data

US 2014/0037490 A1 Feb. 6, 2014

(51) Int. Cl.

| | |
|---|---|
| ***B22F 1/00*** | (2006.01) |
| ***B22F 3/17*** | (2006.01) |
| ***B22F 3/24*** | (2006.01) |

(52) U.S. Cl.

CPC ..... *B22F 1/0014* (2013.01); *B22F 3/24* (2013.01); *B22F 2003/248* (2013.01); *B22F 2998/10* (2013.01)

(58) Field of Classification Search

CPC ..... B22F 1/0014; B22F 2003/248; B22F 2998/10; B22F 3/17; B22F 3/24

USPC ..... 419/38

See application file for complete search history.

(56) References Cited

U.S. PATENT DOCUMENTS

| | | | | |
|---|---|---|---|---|
| 3,765,958 | A | | 10/1973 | Freche et al. |
| 3,976,482 | A | * | 8/1976 | Larson ..... 419/23 |
| 4,066,449 | A | | 1/1978 | Havel |
| 4,318,753 | A | | 3/1982 | Anderson, Jr. et al. |
| 4,365,996 | A | | 12/1982 | Melton et al. |
| 4,601,874 | A | | 7/1986 | Marty et al. |

(Continued)

FOREIGN PATENT DOCUMENTS

| | | |
|---|---|---|
| EP | 0184136 | 6/1986 |
| EP | 1847627 | 10/2007 |

(Continued)

OTHER PUBLICATIONS

Mesh to Micron Conversion Chart. N.p., n.d. Web. Aug. 18, 2015.*

(Continued)

*Primary Examiner* — Colleen P Dunn
*Assistant Examiner* — Anthony M Liang
(74) *Attorney, Agent, or Firm* — Carlson, Gaskey & Olds, P.C.

(57) ABSTRACT

A powder metallurgy method includes (a) forming a metallic powder into a shape, (b) thermo-mechanically forming the shape into an article having a polycrystalline microstructure, (c) heat treating the article to cause coarsening of the polycrystalline microstructure, and (d) controlling the grain size homogeneity and distribution in the article formed during coarsening in step (c) by selecting the metallic powder in step (a) to include a metallic powder particle size distribution that is truncated on fine and coarse particle size sides, the selected metallic powder particle size distribution reducing abnormal grain growth such that the polycrystalline microstructure coarsens to a predefined target grain size range.

10 Claims, 2 Drawing Sheets

(56) References Cited

U.S. PATENT DOCUMENTS

| | | | | |
|---|---|---|---|---|
| 4,685,977 | A | 8/1987 | Chang | |
| 5,080,734 | A | 1/1992 | Krueger et al. | |
| 5,395,464 | A | 3/1995 | Davidson | |
| 5,407,634 | A | 4/1995 | Martin et al. | |
| 5,529,643 | A | 6/1996 | Yoon et al. | |
| 5,571,345 | A | 11/1996 | Ganesh et al. | |
| 5,584,947 | A * | 12/1996 | Raymond | C22F 1/10 148/556 |
| 5,649,280 | A | 7/1997 | Blankenship et al. | |
| 5,759,305 | A | 6/1998 | Benz et al. | |
| 5,891,272 | A | 4/1999 | Raymond et al. | |
| 6,059,904 | A | 5/2000 | Benz et al. | |
| 6,551,372 | B1 | 4/2003 | Ewing et al. | |
| 6,908,519 | B2 | 6/2005 | Raymond et al. | |
| 7,763,129 | B2 | 7/2010 | Mourer et al. | |
| 2007/0044873 | A1 | 3/2007 | Aimone | |
| 2009/0000706 | A1 | 1/2009 | Huron et al. | |
| 2009/0133462 | A1 * | 5/2009 | Cairo | B21J 5/00 72/374 |
| 2010/0329883 | A1 | 12/2010 | Mourer et al. | |

FOREIGN PATENT DOCUMENTS

| | | |
|---|---|---|
| EP | 1950322 | 7/2008 |
| GB | 1505794 | 3/1978 |

OTHER PUBLICATIONS

International Search Report and Written Opinion for International Application No. PCT/US2013/050435 completed on Oct. 11, 2013.

International Preliminary Report on Patentability for PCT Application No. PCT/US2013/050435 dated Feb. 12, 2015.

Huron, Eric,et al., Control of Grain Size Via Forging Strain Rate Limits for R'88DT, 9th International Symposium on Superalloys, Sep. 17-21, 2000, United States of America.

ASTM International. Standard test methods for determining average grain size. No. 6, Sep. 3, 2013, p. 1. ISSN: 0003-6951.

European Search Report for European Patent Application No. 13825745.6 completed Sep. 23, 2015.

* cited by examiner

POWDER METALLURGY METHOD FOR MAKING COMPONENTS

BACKGROUND

This disclosure relates to making components by powder metallurgy. Powder metallurgy is often used to manufacture articles, such as disks, shafts and the like, for gas turbine engines. For example, a metallic powder of a desired composition is consolidated and then forged into the final or near-final shape of the article.

To improve the mechanical properties of the article after forging, such as fatigue, strength, creep, and the like mechanical properties, the article can be subsequently heat treated to produce a grain size within a desired target range. A challenge in achieving the desired target grain size range is that the article may include areas of non-homogenously stored energy from the forging step. This uncontrolled stored energy can cause an abnormal or critical grain growth beyond the desired target range during the heat treatment step. As a result, the parameters of the forging step are typically tightly controlled and the complexity of the shape of the article is limited, to homogenize the level of stored energy though the part and therefore to reduce the abnormal grain growth.

SUMMARY

A powder metallurgy method according to an exemplary aspect of the present disclosure includes (a) forming a metallic powder into a shape, (b) thermo-mechanically forming the shape into an article having a polycrystalline microstructure, (c) heat treating the article to cause coarsening of the polycrystalline microstructure, and (d) controlling the grain size homogeneity and distribution in the article formed during coarsening in step (c) by selecting the metallic powder in step (a) to include a metallic powder particle size distribution that is truncated on fine and coarse particle size sides, the selected metallic powder particle size distribution reduces driving forces for an abnormal grain growth such that the polycrystalline microstructure coarsens to a predefined target grain size range.

In a further non-limiting embodiment, step (d) includes controlling a size distribution of pores and inclusions in the article by selecting the metallic powder in step (a) to include the metallic powder particle size distribution that is truncated on the fine and coarse particle size sides.

A further non-limiting embodiment of any of the foregoing examples includes improving fatigue performance of the article by controlling the grain size homogeneity and distribution in the article formed during the coarsening in step (c) and controlling a size distribution of pores and inclusions in the article, by selecting the metallic powder in step (a) to include the metallic powder particle size distribution that is truncated on the fine and coarse particle size sides.

In a further non-limiting embodiment of any of the foregoing examples, the metallic powder is a superalloy.

In a further non-limiting embodiment of any of the foregoing examples, the metallic powder particle size distribution is truncated below 0.5 micrometers and above 200 micrometers.

In a further non-limiting embodiment of any of the foregoing examples, the metallic powder particle size distribution is truncated below 5 micrometers and above 160 micrometers.

In a further non-limiting embodiment of any of the foregoing examples, the metallic powder particle size distribution is truncated below 15 micrometers and above 140 micrometers.

In a further non-limiting embodiment of any of the foregoing examples, the metallic powder is a nickel- or cobalt-based composition and the metallic powder particle size distribution is truncated below 0.5 micrometers and above 200 micrometers.

In a further non-limiting embodiment of any of the foregoing examples, the predefined target grain size range is ASTM grain size of 4-8.

A powder metallurgy method according to an exemplary aspect of the present disclosure includes (a) reducing a size of largest inclusions, pores or both in a metallic powder and (b) using the metallic powder from (a) to form an article.

In a further non-limiting embodiment of any of the foregoing examples, step (b) includes forming the metallic powder into a shape, thermo-mechanically forming the shape into the article having a polycrystalline microstructure, and heat treating the article to cause coarsening of the polycrystalline microstructure.

A further non-limiting embodiment of any of the foregoing examples includes reducing the size of largest inclusions, pores or both in the article by at least 15%.

A further non-limiting embodiment of any of the foregoing examples includes narrowing the powder particle size distribution by truncating a particle size distribution of the metallic powder below 0.5 micrometers and above 200 micrometers.

A further non-limiting embodiment of any of the foregoing examples includes narrowing the powder particle size distribution by truncating a particle size distribution of the metallic powder below 5 micrometers and above 160 micrometers.

A further non-limiting embodiment of any of the foregoing examples includes narrowing the powder particle size distribution by truncating a particle size distribution of the metallic powder below 15 micrometers and above 140 micrometers.

A powder metallurgy method according to an exemplary aspect of the present disclosure includes improving fatigue performance of an article that is formed using a metallic powder by selecting the metallic powder to include a metallic powder particle size distribution that is truncated on fine and coarse particle size sides, the improved fatigue performance being a result of grain size homogeneity and narrower distribution due to a reduction of abnormal grain growth in the article during heat treating, as well as a reduction in a largest size of inclusions and pores in the article due to the selected metallic powder particle size distribution.

In a further non-limiting embodiment of any of the foregoing examples, the metallic powder particle size distribution is truncated below 0.5 micrometers and above 200 micrometers.

In a further non-limiting embodiment of any of the foregoing examples, the metallic powder particle size distribution is truncated below 15 micrometers and above 140 micrometers.

An article according to an exemplary aspect of the present disclosure includes a superalloy composition having a polycrystalline microstructure with homogeneous grain size such that the grains of the polycrystalline microstructure are all within an ASTM grain size number of 4-8.

In a further non-limiting embodiment of any of the foregoing examples, the superalloy is a nickel- or cobalt-based superalloy.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
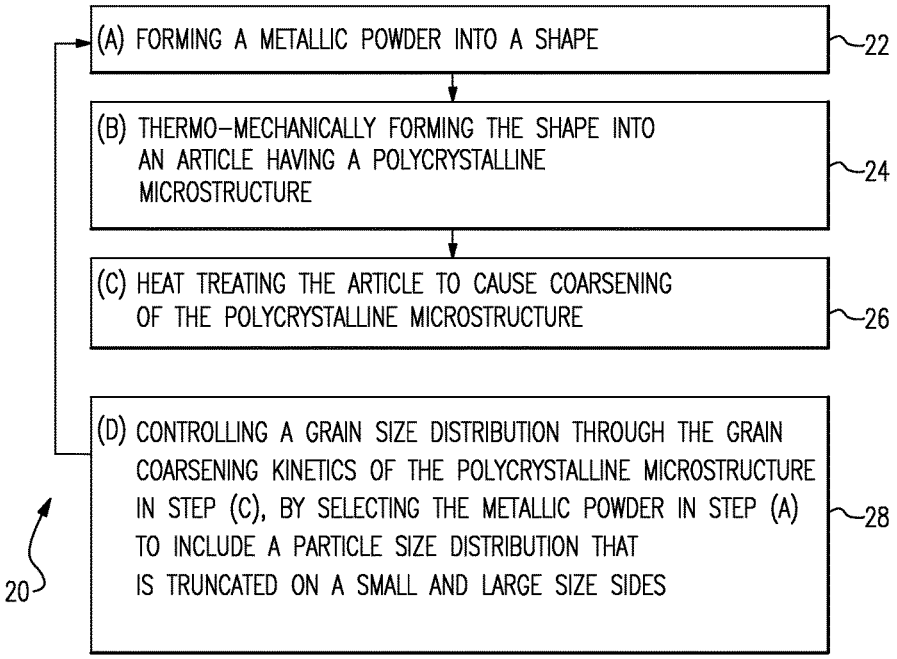
FIG. 1 shows an example powder metallurgy method.

FIG. 1 illustrates an example of a powder metallurgy method 20 for making components, such as gas turbine engine articles. As will be described, the method 20 represents an alternative approach to tightly controlling forging parameters to control grain size and, ultimately, mechanical properties such as strength, low cycle fatigue and creep of articles formed via powder metallurgy route.

In this example, the method 20 includes an initial formation step 22, a thermo-mechanical formation step 24, a heat treatment step 26 and a selection step 28. The initial formation step 22 includes forming a metallic powder into a shape. In embodiments, the composition of the metallic powder is a superalloy, such as a nickel- or cobalt-based alloy. As an example, the forming includes consolidating the metallic powder to form the desired shape. In one example, the consolidation includes hot compacting the metallic powder into a green body and extruding the green body to produce an intermediate work piece. In other examples, the metallic powder is consolidated by hot isostatic pressing. Other consolidation processes can also be used. The parameters for hot compaction and extrusion, or hot isostatic pressing, will depend upon the composition of the metallic powder, for example. Given this disclosure, the ordinary skilled artisan will be able to recognize parameters of consolidation to meet their particular needs for a given composition.

The thermo-mechanical formation step 24 includes forging the final work piece from the initial formation step 22 to provide an article. The thermo-mechanical formation step 24 may be a multi-step operation to form, such as by superplastic deformation, the final shape of the article, with a polycrystalline microstructure. The forging is conducted under conditions, with respect to temperature and press parameters, which are selected based upon the composition of the metallic powder, shape of the end use article and influence on the microstructure, for example. Given this disclosure, the ordinary skilled artisan will be able to recognize parameters of the forging to meet their particular needs.

The heat treatment step 26 includes exposing the final work piece from the thermo-mechanical formation step 24 to an elevated temperature for a predetermined period of time to generate the required microstructure and mechanical properties of the final article. For example, the grain size of the final work piece is finer than desired due to the relatively fine size of the starting metallic powder. The heat treatment step 26 causes coarsening of the polycrystalline microstructure and thereby influences strength, low cycle fatigue, creep and other mechanical properties of the article. The elevated temperature and time are selected based upon the composition of the metallic powder for example. For a nickel- or cobalt-based superalloy, the elevated temperature may be above the gamma prime phase temperature, which is typically 2070° F./1132° C. or greater. Given this disclosure, the ordinary skilled artisan will be able to recognize parameters of the heat treating to meet their particular needs.

The selection step 28 involves a purposeful selection of the metallic powder in the initial formation step 22 to include a particle size distribution that is truncated on a fine and a coarse particle size side. This selection allows to alter the grain coarsening kinetics of the polycrystalline microstructure in the heat treatment step 26 and thus to control the final grain size homogeneity and distribution in the article. In addition, the intentional selection of powder particle size controls size distribution of non-metallic inclusions in the article as well as size distribution of porosity. Thus, a premise of the selection step 28 is that purposeful selection of the size distribution of the metallic powder influences the downstream steps in the method 20 and, ultimately, the mechanical properties of the final article. Inclusions and pores are inducted during the process of powder making and their size is directly related to the powder size.

When the shape is deformed in the thermo-mechanical formation step 24 a softening mechanism so-called dynamic recrystallization (DRX) occurs. In the range of parameters applied in step 24 the particle size of the metallic powder influences the kinetics of DRX. For the unrestricted particle size distribution metallic powder, the local volumes of finer or coarser particle clusters that formed during the forming step 22 will exhibit different levels of stored energy that ultimately will influence grain growth kinetics in the heat treatment step 26 of the final article. Purposeful selection of the particle size distribution of the metallic powder allows for elimination of the stored energy non-homogeneity and therefore controlled grain growth to a defined target range, as well as reduction of largest size inclusions and pores in the article. Grain size, inclusions and porosity all influence the mechanical properties of the article. Thus, by more closely controlling the metallic powder particle size distribution, the properties of the article are controlled and can be tailored for the end use.

Figure 2:
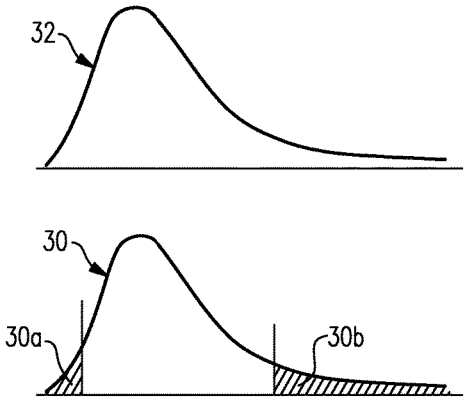
FIG. 2 shows powder particle size distributions for an unrestricted (baseline) particle size distribution and a truncated particle size distribution.

FIG. 2 shows an example of selecting the metallic powder to include a particle size distribution that is truncated on a fine particle size side and a coarse particle size side. As an example, the particle size distribution can be truncated using selected mesh sizes. Curve 30 represents the particle size distribution of the metallic powder used in the method 20, and curve 32 represents an uncontrolled baseline particle size distribution. The curves 30 and 32 are plots of particle size frequency versus particle size. As shown, curve 30 includes a first truncated portion 30*a* on a fine particle size side (the left side of the curve 30) and a second truncated portion 30*b* on a coarse particle size side (the right side of the curve 30). The curve 32 is not truncated and thus represents a natural or "uncontrolled" particle size distribution, which in this example is a chi-square distribution.

The curve 30 with truncated portions 30*a* and 30*b* provides narrower particle size distribution than the curve 32. As a result of the truncation of curve 32, extremely fine and extremely coarse particles are eliminated from the metallic powder particle size distribution. The truncation of the extremely fine particles facilitates the reduction of particle segregation and clustering of very fine particles during the initial forming step 22, which is a consolidation of the metallic powder into a shape. In turn, homogenization of the shape microstructure by elimination of very coarse particles and clusters of very fine particles eliminates the areas of non-homogenous stored energy at the forging step 24 that causes the abnormal grain growth during the heat treatment step 26.

Figure 3:
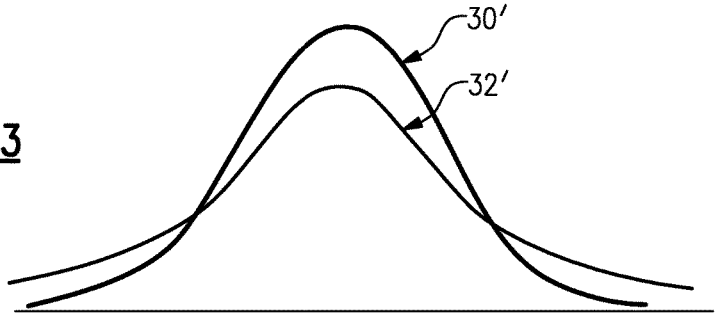
FIG. 3 shows article grain size distributions after a heat treatment step corresponding to a truncated powder particle size distribution and an unrestricted (baseline) particle size distribution.

FIG. 3 shows a graph of grain size distribution for grain size frequency versus grain size obtained after the heat treatment step 26. Curve 30' represents the grain size distribution that corresponds to the particle size distribution of curve 30, and curve 32' represents the grain size distribution that corresponds to the particle size distribution of curve 32. As shown, the curve 30' has a narrower distribution than curve 32'. Thus, the truncation of the metallic powder distribution (curve 30) reduces abnormal grain growth and results in the narrower grain size distribution. In one example, the narrower distribution is designated by a predefined target grain size range, such as an ASTM grain size number of 4-8 according to ASTM standard E112. That is, in an article that is formed according to the method 20, having a superalloy composition, such as a nickel- or cobalt-based material, with a polycrystalline microstructure defining a uniform grain size, the grains of the polycrystalline microstructure are all within the ASTM grain size number of 4-8. Further, the ASTM grain size number of 4-8 is narrower than the grain size distribution that results from making the same article, under the same conditions, but using the uncontrolled baseline particle size distribution. For instance, a baseline article made using the uncontrolled baseline particle size distribution has grains that are within an ASTM grain size number of 1-8.

The particles of the metallic powder may have porosity and non-metallic inclusions that form during the powder production process, for example. Inclusions and pores can act as stress concentrators that weaken an article. The extremely coarse metallic powder particles are more likely to have large pores. During the initial forming steps, for example powder sieving, uncontrolled powder distribution will result in induction of larger inclusions and pores in the powder product. Thus, eliminating the extremely coarse particles in the truncated curve 30 facilitates the elimination of large inclusions and large pores.

Figure 4:
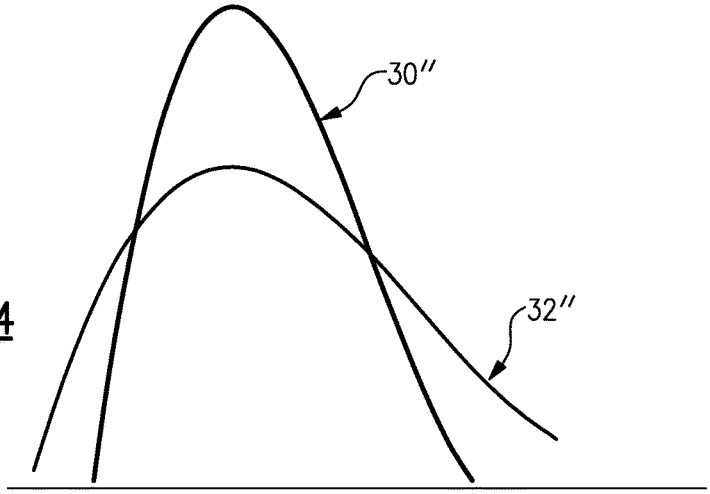
FIG. 4 shows inclusion or pore size distributions corresponding to a truncated powder particle size distribution and an unrestricted (baseline) particle size distribution.

FIG. 4 shows a graph of inclusion size distribution for inclusion size frequency versus inclusion size. Curve 30' represents the inclusion size distribution that corresponds to the metallic powder particle size distribution of curve 30, and curve 32' represents the inclusion size distribution that corresponds to the metallic powder particle size distribution of curve 32. The curves 30' and 32' are also representative of the pore size distributions that correspond, respectively, to the curves 30 and 32. As shown, the curve 30' has a narrower distribution than curve 32' and the largest inclusion/pore size is truncated. In one example, the truncation of the curve 30 reduces the size of the largest inclusions, pores or both, relative to the natural or "uncontrolled" particle size distribution as in curve 32 (a chi-square distribution). In one example, the reduction in size is at least 15%. Therefore, in another aspect, a disclosed method includes reducing a size of the largest inclusions, pores or both by a percentage in a metallic powder and then using the metallic powder to form the article.

Figure 5:
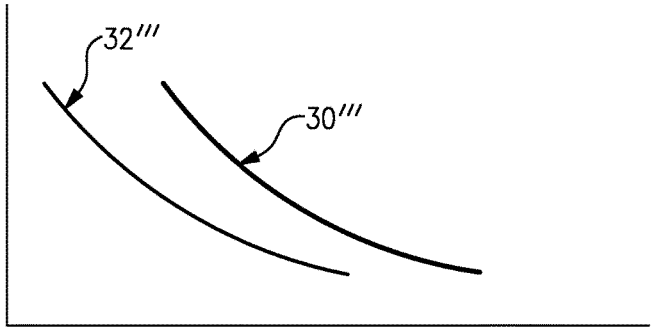
FIG. 5 shows low cycle fatigue performance corresponding to a truncated powder particle size distribution and an unrestricted (baseline) particle size distribution.

FIG. 5 shows a graph of low cycle fatigue plotted as applied stress versus number of cycles to failure after the heat treatment step 26. Curve 30' represents the low cycle fatigue performance that corresponds to the particle size distribution of curve 30, and curve 32' represents the low cycle fatigue performance that corresponds to the particle size distribution of curve 32. As shown, the curve 30' is shifted (to the right in FIG. 5), indicating an improvement in fatigue to a higher number of cycles for a given stress. The improvement in the fatigue performance of the article is due to selecting the metallic powder to include the truncated powder particle size distribution. This ultimately reduces the size of the largest inclusions in the metallic powder, reduces the size of largest pores in the article, and produces more homogenous and narrower grain size distribution due to the reduction of abnormal grain growth during heat treating such that a polycrystalline microstructure of the article coarsens to the predefined target grain size range.

In one example, the particle size distribution as represented by curve 30 is truncated at the first truncated portion 30*a* below 0.5 micrometers and at the second truncated portion 30*b* above 200 micrometers such that the metallic powder has a size between 0.5 micrometers and 200 micrometers. The particle sizes selected for truncation depend upon the degree of control desired over the grain size distribution, inclusion size distribution and pore size distribution. Thus, a relatively narrower or wider particle size distribution can be selected for different effects or for different compositions of metallic powder.

In further examples based upon a superalloy composition, such as a nickel- or cobalt-based material, the particle size distribution as represented by curve 30 is truncated at the first truncated portion 30*a* below 5 micrometers and at the second truncated portion 30*b* above 160 micrometers. In this example, the use of the relatively narrower particle size distribution facilitates a greater improvement in low cycle fatigue, which is a property of interest in gas turbine engine components, for example. To further improve low cycle fatigue performance in superalloy compositions, the powder particle size distribution as represented by curve 30 is truncated at the first truncated portion 30*a* below 15 micrometers and at the second truncated portion 30*b* above 140 micrometers.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A powder metallurgy method comprising:

(a) consolidating a metallic powder into a shape;

(b) thermo-mechanically forging the shape into an article having a polycrystalline microstructure;

(c) heat treating the article to cause coarsening of the polycrystalline microstructure; and (d) controlling the grain size homogeneity and distribution in the article formed during coarsening in step (c) by selecting the metallic powder in step (a) to include a metallic powder particle size distribution that is truncated on fine and coarse particle size sides, the selected metallic powder particle size distribution reducing abnormal grain growth such that grains of the polycrystalline microstructure coarsen and are all within an ASTM grain size number of 4-8.

2. The method as recited in claim 1, wherein step (d) includes controlling a size distribution of pores and inclusions in the article by selecting the metallic powder in step (a) to include the metallic powder particle size distribution that is truncated on the coarse particle size sides.

3. The method as recited in claim 1, further including improving fatigue performance of the article by controlling the grain size homogeneity and distribution in the article formed during the coarsening in step (c) and controlling a size distribution of pores and inclusions in the article, by selecting the metallic powder in step (a) to include the metallic powder particle size distribution that is truncated on the fine and coarse particle size sides.

4. The method as recited in claim 1, wherein the metallic powder is a superalloy.

5. The method as recited in claim 1, wherein the metallic powder particle size distribution is truncated below 0.5 micrometers and above 200 micrometers.

6. The method as recited in claim 1, wherein the metallic powder particle size distribution is truncated below 5 micrometers and above 160 micrometers.

7. The method as recited in claim 1, wherein the metallic powder particle size distribution is truncated below 15 micrometers and above 140 micrometers.

8. The method as recited in claim 1, wherein the metallic powder is a nickel- or cobalt-based composition and the metallic powder particle size distribution is truncated below 0.5 micrometers and above 200 micrometers.

9. The method as recited in claim 1, wherein the consolidating of said step (a) includes at least one of extrusion or hot isostatic pressing.

10. A powder metallurgy method comprising:

improving fatigue performance of an article that is formed using a metallic powder by selecting the metallic powder to include a metallic powder particle size distribution that is truncated on a fine particle size side below 15 micrometers and a coarse particle size side above 140 micrometers, the improved fatigue performance being caused by homogenous and narrower grain size distribution achieved by a reduction in abnormal grain growth in the article during heat treating such that grains of a polycrystalline micro structure of the article coarsen and are all within an ASTM grain size number of 4-8, and there is a reduction in a largest size of inclusions and pores in the article due to the selected metallic powder particle size distribution.

* * * * *